US005950405A

United States Patent [19]

Wolfel et al.

[11] Patent Number: 5,950,405

[45] Date of Patent: Sep. 14, 1999

[54] HANDLING DEVICE FOR LAYERED CELLULOSE PRODUCTS, IN PARTICULAR COTTON WOOL PADS

[75] Inventors: Peter Wolfel, Nuremberg, Germany; Jean-Pierre Pringuer, Saint Augin les Elbeuf, France; Christof Karl Stary, Eckental, Germany

[73] Assignee: The Procter & Gamble Company, Cincinnati, Ohio

[21] Appl. No.: 08/913,102

[22] PCT Filed: Mar. 5, 1996

[86] PCT No.: PCT/US96/02964

§ 371 Date: Apr. 1, 1998

§ 102(e) Date: Apr. 1, 1998

[87] PCT Pub. No.: WO96/28347

PCT Pub. Date: Sep. 19, 1996

[30] Foreign Application Priority Data

Mar. 8, 1995 [DE] Germany ..... 195 08 248

[51] Int. Cl.[6] ..... B65B 35/50

[52] U.S. Cl. ..... 53/540; 53/542

[58] Field of Search ..... 53/115, 521, 522, 53/540, 542

[56] References Cited

U.S. PATENT DOCUMENTS 1,573,599 2/1926 Elliott .
3,474,592 10/1969 Hessner .
3,731,451 5/1973 Sexstone et al. .
3,910,010 10/1975 Cowley et al. .
3,990,209 11/1976 Eisenberg .
4,048,785 9/1977 Wright .
4,056,919 11/1977 Hirsch .
4,514,964 5/1985 Langen .
4,558,619 12/1985 Caumont .
4,708,042 11/1987 Jung .
4,895,487 1/1990 Fluck .
4,982,556 1/1991 Tisma .
5,010,715 4/1991 Fluck .
5,083,486 1/1992 Allison et al. .
5,134,832 8/1992 Pesendorfer et al. .
5,199,245 4/1993 Daddario et al. .

*Primary Examiner*—Daniel B. Moon
*Attorney, Agent, or Firm*—Vladimir Vitenberg; Larry L. Huston; E. Kelly Linman

[57] ABSTRACT

A handling device for conveying layered cellulose products (1), such as cotton wool pads formed successively during production, between a production station (2) and a packaging station (3) is provided with an intermediate storage system (4) with at least one pair of separate holding chambers (5, 6) for the serial holding of the cellulose products (1) delivered successively from the production station (2) to the packaging station (3) and for the transfer of the cellulose products (1) held in this way as a package (67) into a respective conveying cartridge (10). One holding chamber (5) of the pair can be coupled to the outlet of the production station (2) at the same time the other holding chamber (6) is in a transfer station (11) and is coupled to a conveying cartridge (10).

10 Claims, 9 Drawing Sheets

HANDLING DEVICE FOR LAYERED CELLULOSE PRODUCTS, IN PARTICULAR COTTON WOOL PADS

The invention relates to a handling device for conveying layered cellulose products, in particular cotton wool pads, formed in succession during production, between a production station and a packaging station.

The formerly conventional method of handling during the conveyance of such cellulose products between a production station and a packaging station or a similar further processing unit such as a skein forming unit or the like and the resultant problems will be described hereinafter with reference to the production of cotton wool pads. These cotton wool pads are produced from a web of cellulose using a stamping machine, the cotton wool pads being inserted in succession into a tube leading away from the stamping machine and being carried away from the stamping machine. As new cotton wool pads are continuously inserted into the tube, a stack is formed in the tube and is pushed through the tube owing to the pressure of the respective newly arriving cotton wool pads. At the end of the respective tube remote from the stamping machine, a partial stack, which comprises a number of cotton wool pads corresponding to the respective packaging unit and is inserted into a bag placed on the end of the tube, is separated manually from the stack.

An alternative to this manual method of handling is described in DE 43 16 363 A1, which describes an automatic device for loading these bags. This loading device is in turn arranged at the end of the tube remote from the stamping machine and has a separating unit for splitting the stack into partial stacks and a discharge system for conveying the partial stack from the separating unit into the bag.

A problem during the above-mentioned conveyance of the cotton wool pads from the production station to the packaging station is that the individual cotton wool pads are shaped into a continuous stack which is pushed along in a tube. On the one hand, owing to the shaping into a continuous stack, it is necessary to open the stack for packaging in partial stacks again, which necessitates either labour-intensive manual activity or a constructionally complex loading device of the type described in DE 43 16 363 A1. On the other hand, the conveyance of the cotton wool pads from the production station to the packaging station in the form of a stack in a tube is susceptible to breakdown and can adversely affect the quality of the cotton wool pads. For example, the cut edges of the cotton wool pads can be damaged by their contact with the tube wall.

Furthermore, owing to the virtually continuous conveyance of the cotton wool pads from the production stamping machine to the packaging station, the problem arises that the entire stack comes to a standstill when the stamping process is interrupted and packaging therefore also has to be interrupted. In this respect, there is no cushion effect with the known method of conveying the cotton wool pads from the production station to the packaging station.

On the basis of the above-mentioned problems, the object of the invention is to provide a handling device for conveying layered cellulose products formed in succession during production between a production and packaging station, with which the cellulose products can immediately be formed into partial stacks with a number of products which corresponds to the packaging unit and with which the continuous conveyance of the products in a continuous stack and the associated problems are avoided.

This object is achieved by the features mentioned. The handling device for said conveyance of cellulose products is accordingly provided with an intermediate storage system which follows the production station and comprises at least one pair of separate holding chambers for the serial holding of the successive cellulose products delivered from the production station in a number corresponding to the packaging unit and for the transfer of the cellulose products held in this way as a package into a respective conveying cartridge. One holding chamber of this pair, of which there is at least one, can be coupled alternately to the outlet of the production station and at the same time the other holding chamber in a transfer station to the respective conveying cartridge. A conveyor belt is also provided by means of which a plurality of such conveying cartridges is transferred between the transfer station in which a respective package of cellulose products is transferred from one of the holding chambers of the intermediate storage system into an associated conveying cartridge and can be conveyed to the packaging station in which the content of a respective conveying cartridge is conveyed into a sales container, for example a bag.

With the described intermediate storage system, on the one hand, the successively formed cellulose products are now immediately formed into partial stacks comprising the desired number of products. On the other hand, the intermediate storage system also serves to convey these partial stacks in that the holding chambers of the intermediate storage system can each be coupled alternately to the production station and the specified transfer station. It is therefore completely unnecessary to transport the cellulose products by pushing them over a prolonged distance through a tube. Furthermore, the use of a conveyor belt on which a plurality of conveying cartridges is handled provides a cushion. In fact, there is always a certain number of conveying cartridges filled with cellulose products and re-emptied conveying cartridges available in the region of the conveyor belt. This means that the packaging station can continue operating, for example during an interruption in production in the region of the cotton wool pad stamping machine and vice versa.

Further features, details and advantages of the invention and preferred embodiments thereof can be inferred from the sub claims and the following description in which an embodiment of the subject of the invention is described in detail with reference to the accompanying drawings.

Figure 1:
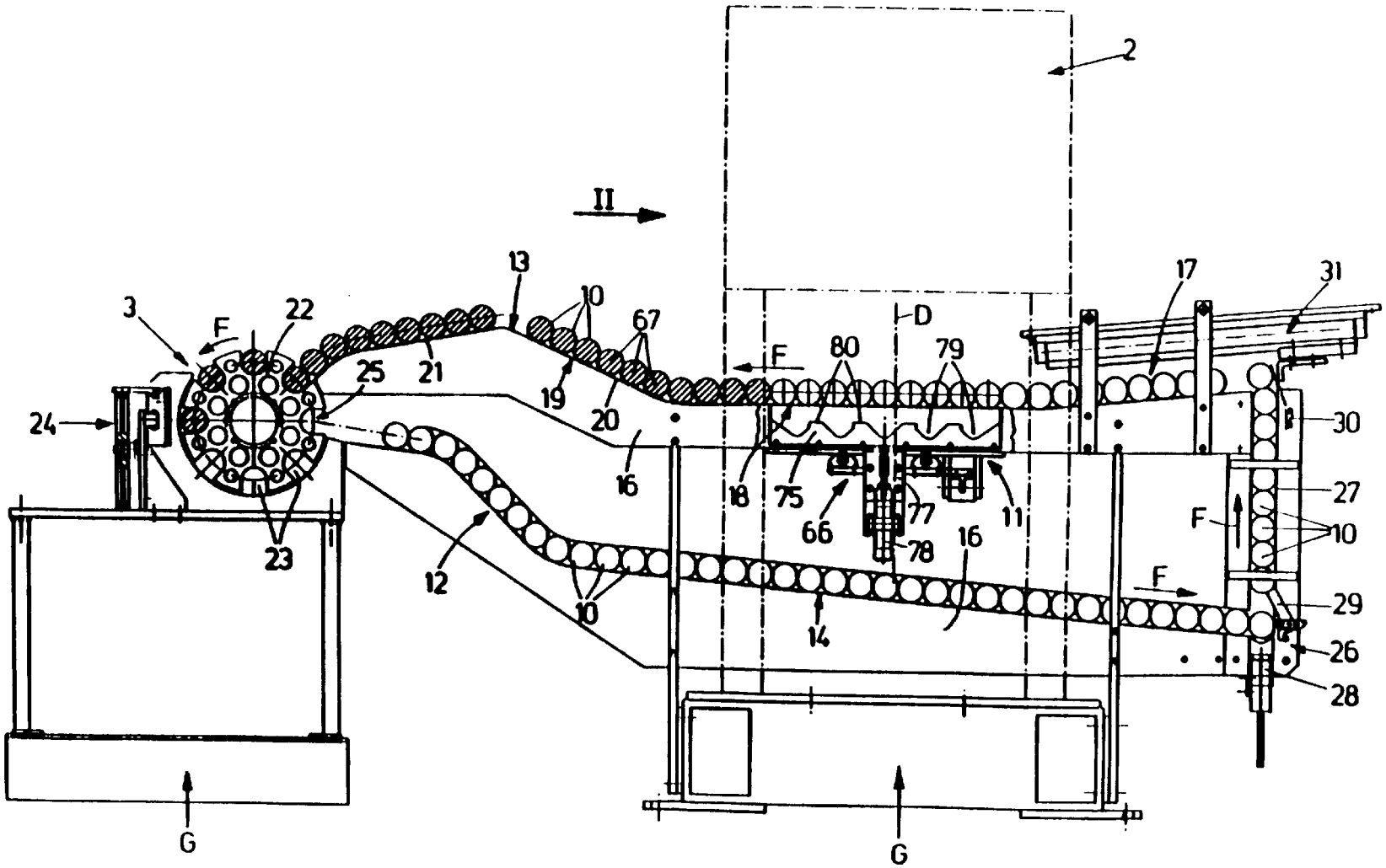
FIG. 1 is a front view of the handling device.
Figure 2:
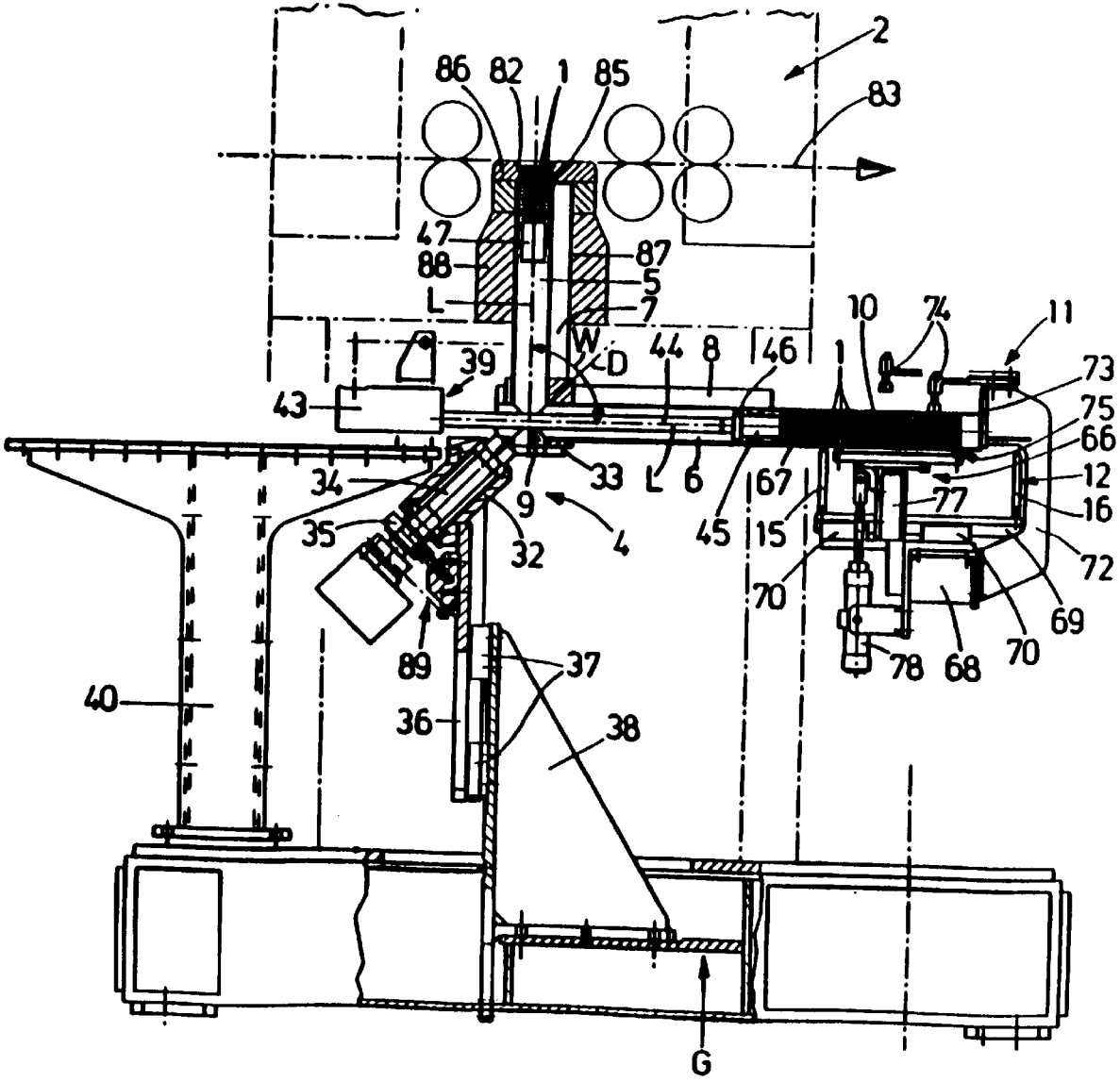
FIGS. 2 and 3 are views from the direction of the arrow II in FIG. 1 in different positions of the intermediate storage system of the handling device.

FIGS. 1 and 2 show a handling device according to the invention which is used to convey cotton wool pads 1 between a stamping machine 2 indicated in dot dash lines as production station and a packaging station 3 shown in fragmented form in the left-hand part of FIG. 1.

As a general view, the main components of the handling device which are arranged on a branched multi-part frame G will be outlined briefly hereinafter. Thus, the stamping machine 2 is followed by an intermediate storage system which is designated as a whole by 4 and is provided with eight pairs of holding chambers 5, 6 arranged next to one another transversely to the plane of observation in FIG. 2. The holding chambers 5, 6 are formed as through-orifices in two holding blocks 7, 8. As shown in FIG. 2, the two holding blocks 7, 8 are arranged relative to one another such that the longitudinal axes L of the holding chambers 5 in one block 7 intersect the longitudinal axes L of the holding chambers 6 in the other holding block 8 at a rightangle W in each case and the holding chambers 5, 6 infiltrate one another in their foot regions (intersecting region 9).

The holding chambers 5, 6 can be coupled alternately, in a manner which will be described hereinafter, to the stamping machine 2 or to a respective conveying cartridge 10 in a transfer station designated as a whole by 11.

Figure 3:
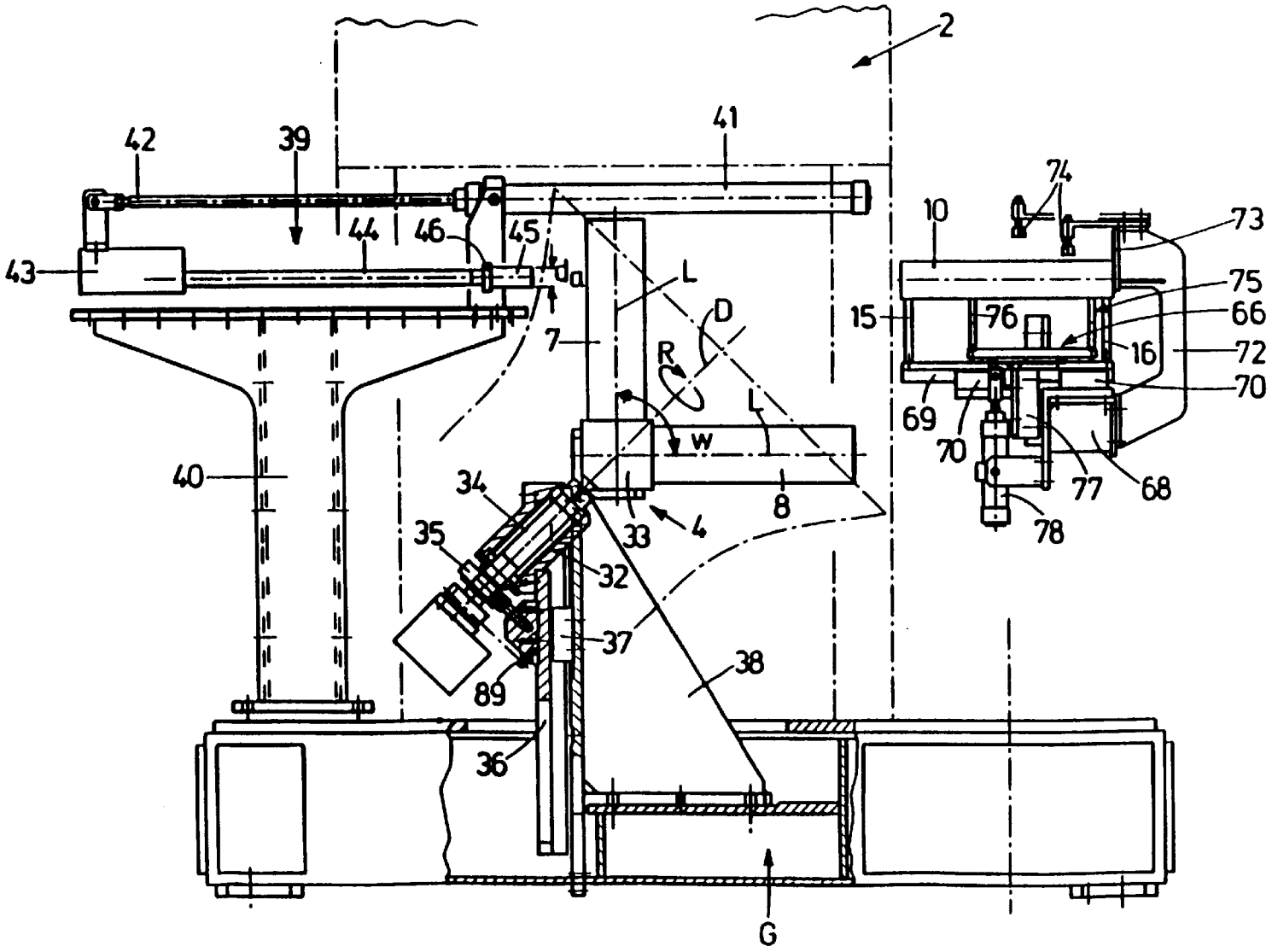
Figure 4:
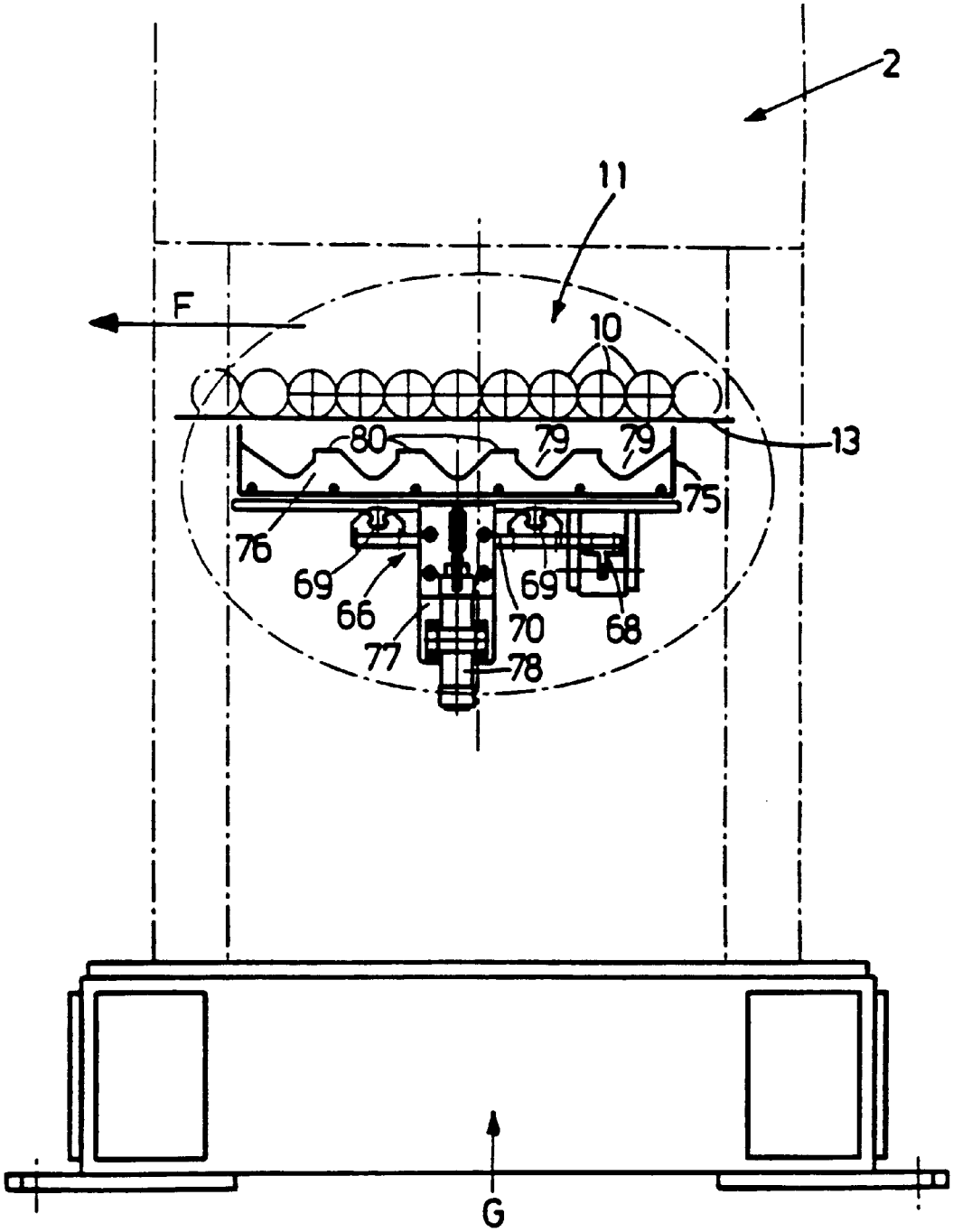
FIGS. 4 and 5 are schematic front views of the transfer station of the handling device.
Figure 7:
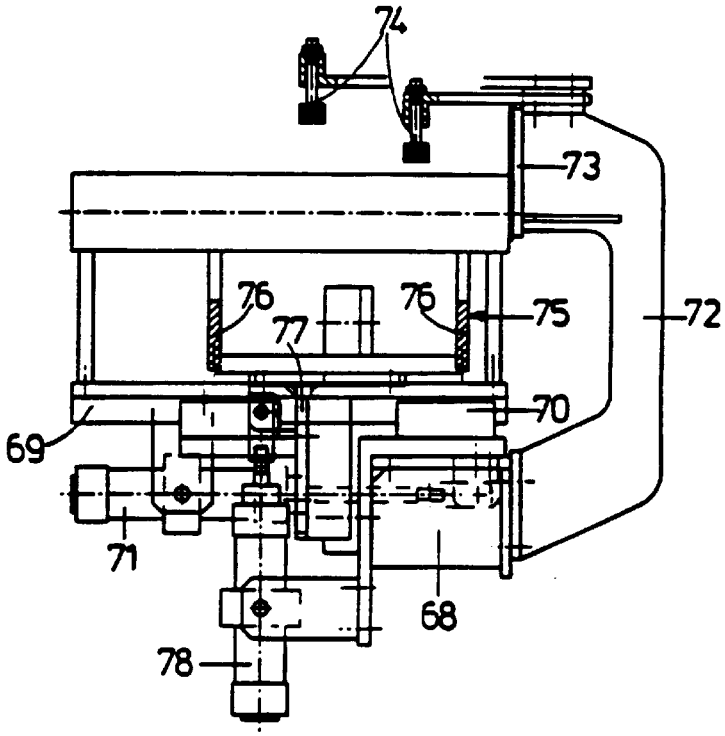

As shown in FIG. 1, a conveyor belt 12 is provided by means of which the numerous conveying cartridges 10 can be conveyed between the transfer station 11 and the packaging station 3 and back again. The conveyor belt 12 consists of an upper apron 13 and a lower apron 14 each comprising rails 15, 16 (FIGS. 2, 3 and 7). The cylindrical conveying cartridges 10 roll thereon, conventional guides, not shown, being provided to guarantee a clean rolling movement without tilting of the conveying cartridges 10.

The upper apron 13 has a supply portion 17 which falls away in the conveying direction F of the conveying cartridges 10 and to which there is attached a horizontal portion 18 in the region of which the transfer station 11 is located. From there, the upper apron 13 continues with a connecting portion 19 composed of a rising flank 20 and a falling flank 21 with respect to the conveying direction F. At the end of the falling flank 21, the upper apron 13 opens into a holding drum 22 of the packaging station 3 in whose chambers 23 a respective conveying cartridge 10 is held. The stack of cotton wool pads 1 located in the respective conveying cartridge 10 is ejected by a discharge device, of which only the driving and guide elements designated by 24 are shown in FIG. 1, and is introduced into a bag. Owing to an intermittent rotation of the holding drum 22 in an anticlockwise direction with respect to FIG. 1, successively filled conveying cartridges 10 are therefore picked up in the chambers 23 of the holding drum 22, are emptied and are conveyed out of the holding drum 22 at the end of the revolving movement in the discharge region 25 and are transferred to the lower apron 14. This is formed continuously as a descending apron with varying inclinations. At its end, the lower apron 14 opens into a lifting device 26 comprising a shaft 27 which leads vertically upwardly to the beginning of the supply portion 17. A lifting piston 28 which can lift a respective conveying cartridge 10 over the reflux barrier 29 is arranged at the lower end of the shaft 27. Successive conveying cartridges 10 are therefore moved upwardly along the shaft 27 until they pass from the shaft 27 into the supply portion 17. During this stage, a schematically indicated counter 30 is actuated and its reading in turn controls an advance system 31 and the lifting piston 28.

As shown in FIG. 2, the two holding blocks 7, 8 are arranged together on a revolving head 33 which is mounted rotatably via a pivot bearing 32 and of which the axis of rotation D coincides with the rotational axis of symmetry between the two identically designed holding blocks 7, 8 with respect to a rotational angle of 180°. This means that, during a rotation R of the revolving head 33 round the axis of rotation D with an angle of 180°, the two holding blocks 7, 8 exchange their position exactly. Furthermore, the revolving head 33 rests with a bearing journal 34 in the pivot bearing 32, its rear end being provided with a gear wheel 35 which engages in a toothed rack 35 actuated linearly by a pneumatic drive. The maximum rotational angle of the revolving head 33 is also limited to exactly 180° by stops 89 which are merely indicated.

As also shown in FIGS. 2 and 3, the pivot bearing 32 for the revolving head 33 is mounted on a vertical slide 36 which is guided vertically movably on a vertical guide 37 on a frame cantilever 38 and can be moved to and fro in this direction between the coupling position shown in FIG. 2 and the alternative position shown in FIG. 3 by a drive which is not shown in detail. Further details of these two positions will be given with reference to the functional description of the handling device.

As can also be inferred from FIGS. 2 and 3, the intermediate storage system 4 is allocated a discharge system 39 which is arranged on a frame column 40. This column has a pneumatic piston/cylinder drive 41 at whose free piston rod end 42 a horizontally movably mounted slide block 43 is arranged. The slide block 43 carries freely projecting discharge rams 44 which are directed in the displacement direction of the slide block 43 and toward the transfer station 11 and of which the number and respective longitudinal axis coincide with the number and respective longitudinal axis of the holding chambers 5, 6 in the holding blocks 7, 8. A respective cylindrical head 45 is shaped at the free ends of the discharge rams 44 and is provided with an annular collar 46 at its rear end. The purpose of this design will be explained in the following description of operation.

Figure 8:
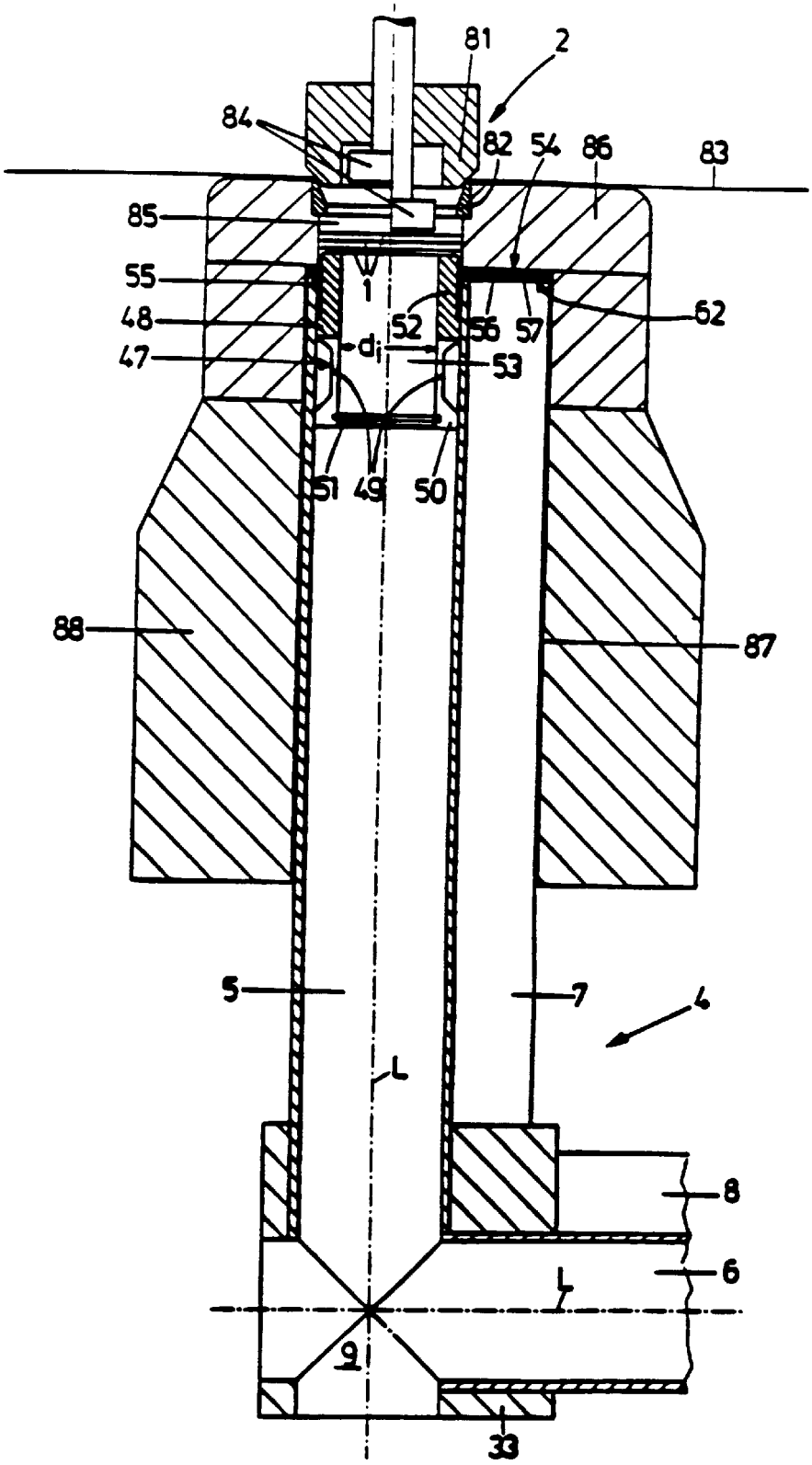
FIGS. 8 and 9 are vertical sections through a stamping machine system with coupled holding block of the handling device.
Figure 9:
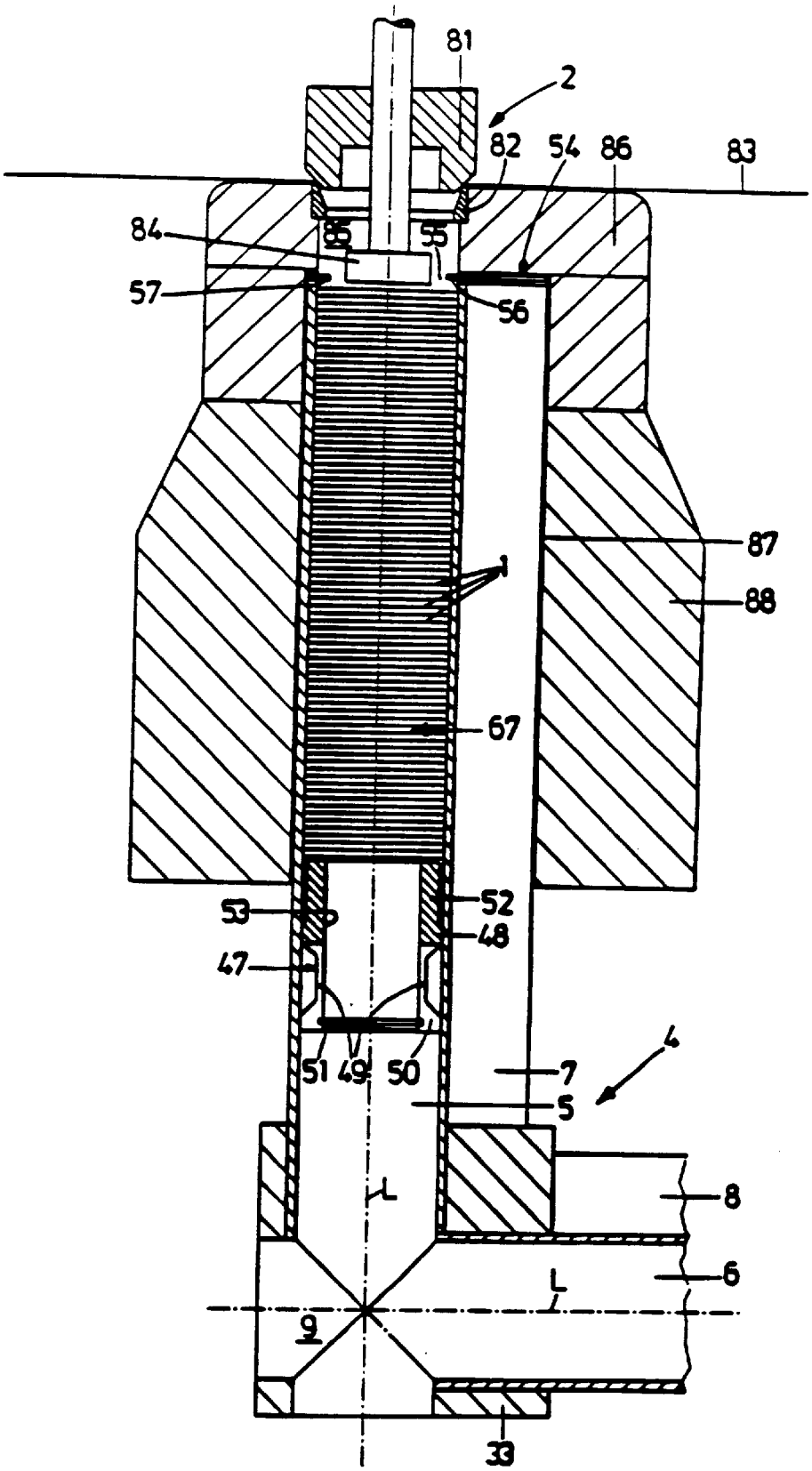

As shown in FIGS. 8 and 9, a so-called "overhanging" piston 47 is mounted displaceably in the direction of the longitudinal axis L in each holding chamber 5, 6 which is designed in the form of a hollow cylinder. For this purpose, each piston 47 has a guide collar 48 and spreading blades 49 which extend parallel to the longitudinal axis L, are distributed over the periphery of the piston 47 and of which the free ends 50 are loaded radially outwardly by a spreading ring 51. The piston 47 therefore remains in the respective position in the holding chamber 5, 6 providing it is not loaded in one of its displacement directions. On the side of the guide collar 48 remote from the spreading blades 49, the piston 47 is provided with an annular shoulder 52. The piston 47 is also provided with a longitudinally axially extending through-aperture 53 of which the internal diameter $d_i$ is slightly greater than the external diameter $d_a$ of the head 45 of the discharge rams 44.

FIGS. 8 to 11 also show a diaphragm system 54 which is arranged in front of the through-aperture 55 at the open end of the holding chambers 5, 6. The diaphragm system 54 has two identically designed diaphragm plates 56, 57 which lie flat on one another and of which the external contour has a roughly zig-zag course and corresponds to the contour of the holding blocks 7, 8.

Figure 10:
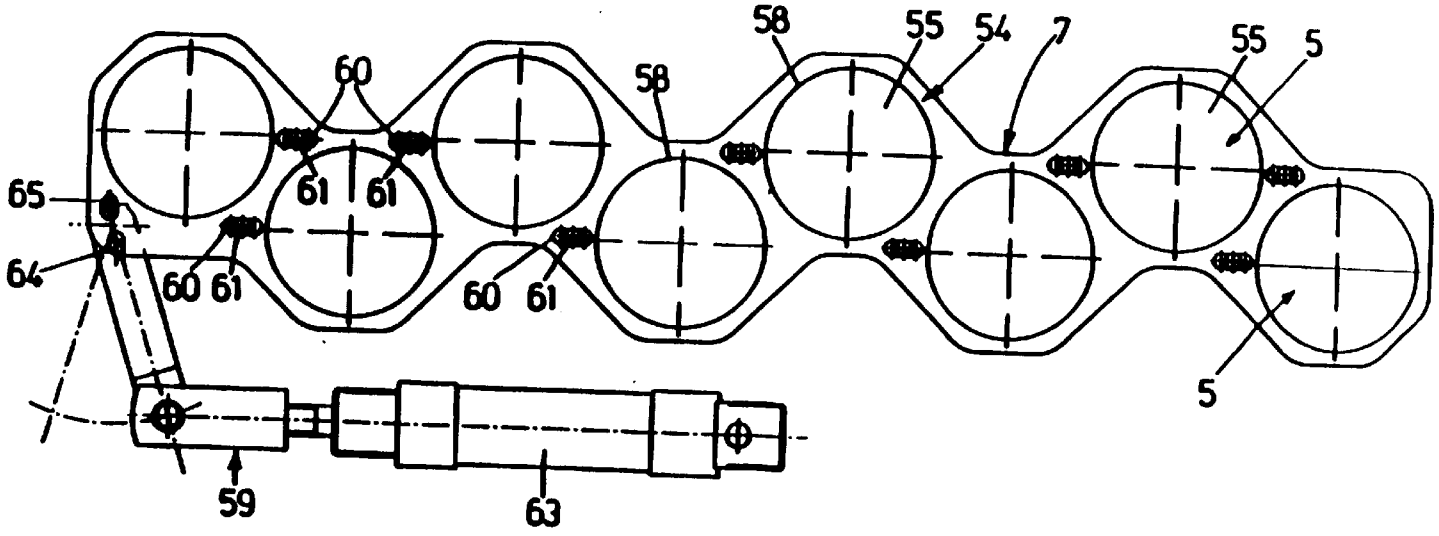
FIGS. 10 and 11 are schematic front views of a holding block with a diaphragm system.
Figure 11:
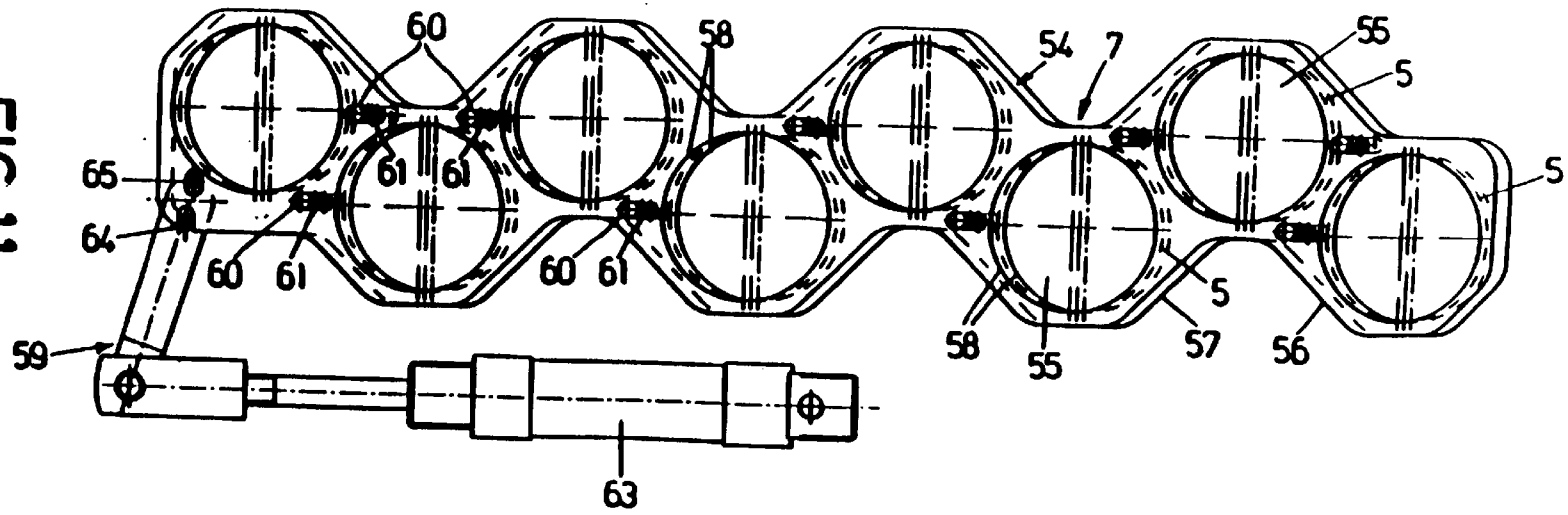

According to this external contour, circular apertures 58 are introduced into the diaphragm plates 56, 57 which, in the open position of the diaphragm system 54 shown in FIGS. 8 and 10, are exactly aligned with the holding chambers 5, 6. The diaphragm plates 56, 57 can be displaced in mutually opposed directions by a pivoting lever mechanism 59 and slots 60 through which guide pins 61 on the end face 62 of the holding blocks 7, 8 penetrate, so the edges of the apertures 58 in the diaphragm plates 56, 57 are each inserted from mutually opposed sides into the free cross section of the through-apertures 55 of the holding chambers 5, 6 and therefore constrict the through-aperture 55. The displacement drive of the diaphragm plates 56, 57 is also produced by a pneumatic piston/cylinder drive 63 of the pivoting lever mechanism 59 which, in turn, acts on the diaphragm plates 56, 57 via corresponding eccentric pins 64, 65.

Figure 5:
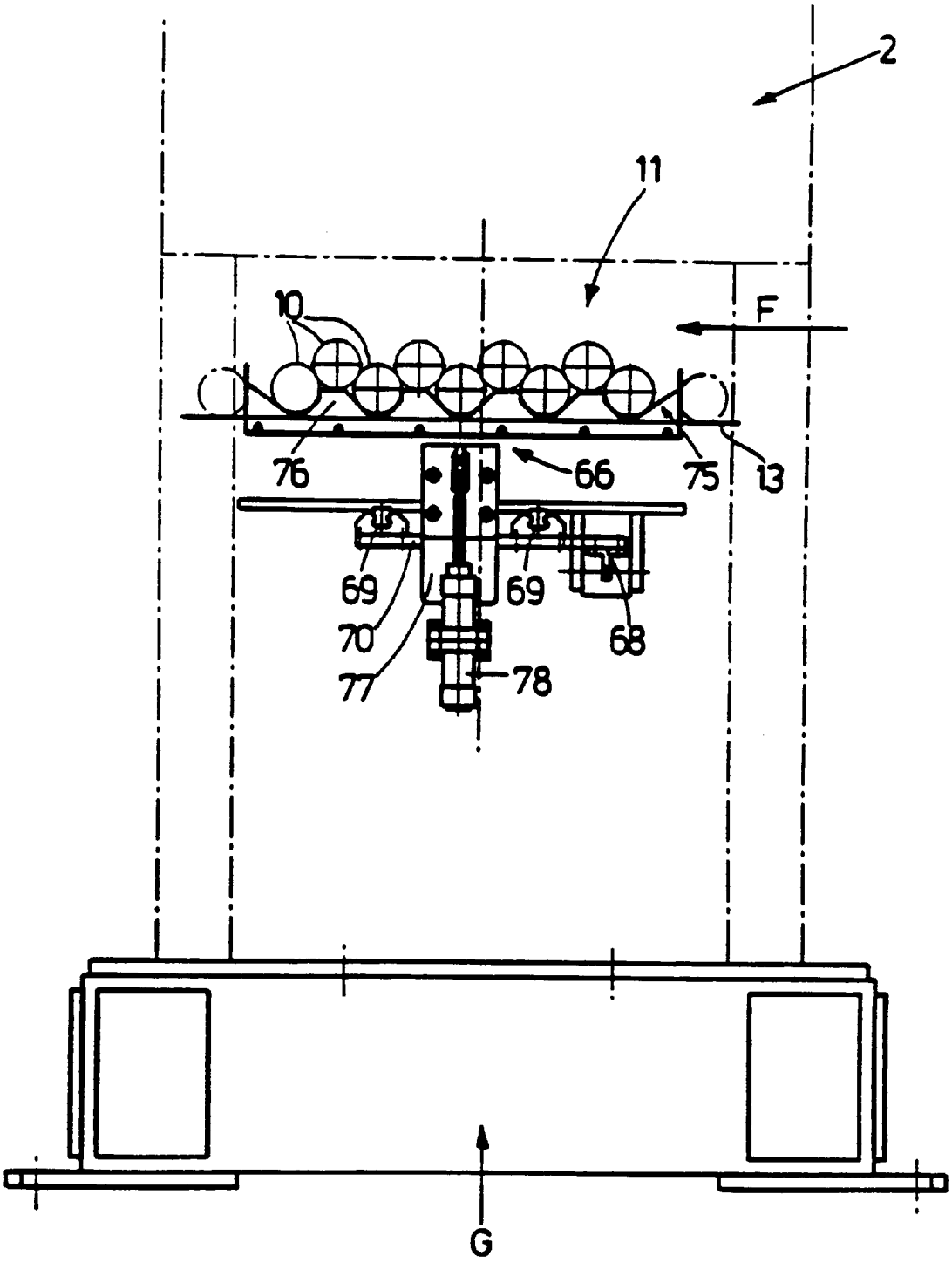
Figure 6:
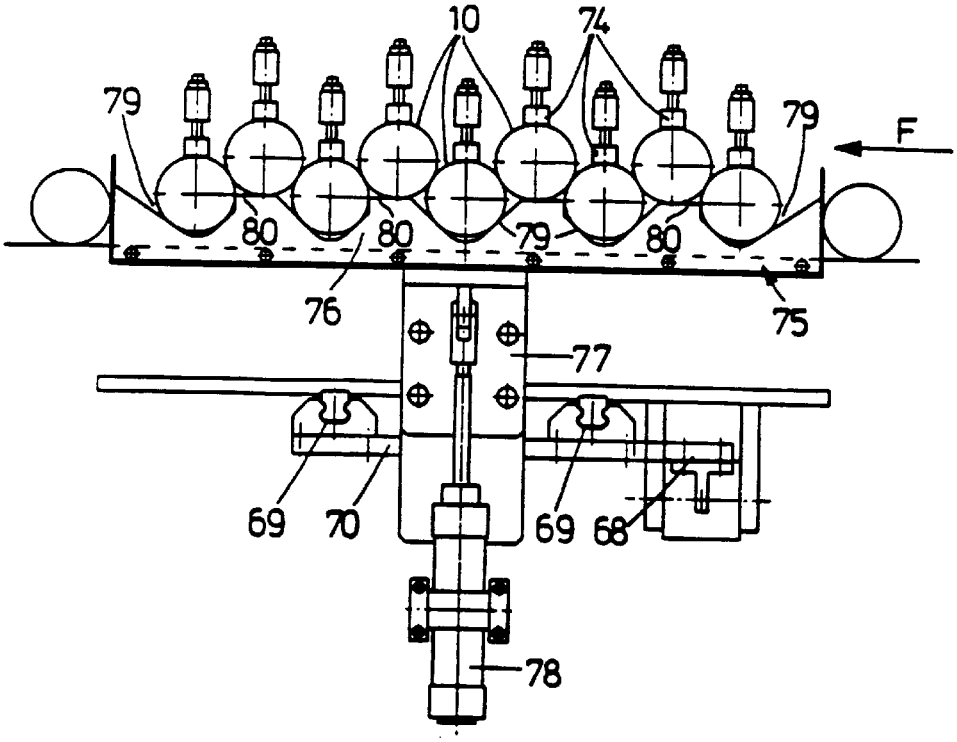
FIGS. 6 and 7 are a front and side view of the transfer station.

The transfer station 11 will now be described in detail with reference to FIGS. 4 to 7. As shown, in particular, in FIG. 7, this transfer station 11 has a manipulation platform which is designated as a whole by 66 and by means of which the empty conveying cartridges 10 supplied from the packaging station 3 via the conveyor belt 12 can be orientated according to the arrangement of the holding chambers 5, 6 in the holding blocks 7, 8 of the intermediate storage system 4 and can be coupled to them in order to transfer the package 67 (FIG. 2) of cotton wool pads 1 located therein. For this purpose, the carrier 68 of the machine frame G holding the rails 15, 16 of the conveyor belt 12 has a transverse guide 69 on which a transverse slide 70 can be displaced transversely to the conveying direction F via the pneumatic piston/cylinder drive 71. On the downwardly suspended transverse slide 70 there is arranged, on the one hand, an upwardly extending cantilever 72 which carries, at its end, a stop plate 73 standing vertically and parallel to the conveying direction V laterally next to the side of the rail 16 remote from the intermediate storage system 4. Holding-down means 74 which extend over the apron 13 and cooperate with an orientating template 75 for the conveying cartridges 10 are provided on the cantilever 72 above the stop plate 73. This orientating template 75 consists of two orientating plates 76 which are arranged parallel to the rails 15, 16 with spacing between them and are arranged on a vertical slide 77. The vertical slide 77 is displaceable in height on the transverse slide 70 via a further pneumatic piston/cylinder drive 78. The orientating plates 76 each have substantially triangular recesses 79 which are open at the top and are lined up with spacing along the length of the orientating plates 76 in such a way that supporting webs 80 remain between the recesses 79. Owing to this design of the orientating plates 76, nine conveying cartridges 10 which are arranged on the rails 15, 16 in the region of the horizontal portion 18 of the upper apron 13 are lifted during the lifting of the orientating template 75 by means of the vertical slide 57 into the zig-zag configuration shown in FIG. 5. In this position, the holding-down means 74 load the individual conveying cartridges 10 from above so the conveying cartridges 10 are located in positions which are exactly defined relative to one another. The conveying cartridges 10 shown by a cross in FIG. 5 are orientated with their longitudinal axes exactly in alignment with the longitudinal axes L of the holding blocks 5 of the respective horizontally standing block 7 and can be coupled directly to these holding chambers 5 by a transverse displacement by means of the transverse slide 70. They are pressed by the stop plate 73 against the end face 62 of the holding block 7 with interposition of the diaphragm plates 56, 57.

The mode of operation of the handling device according to the invention is described in detail hereinafter.

The position of the intermediate storage system 4 in which the vertically directed holding block 7 is coupled to the stamping machine 2 by the upwardly driven vertical slide 36, shown in FIGS. 2 and 8, is used as a basis. As shown in FIG. 8, the stamping machine 2 comprises eight stamping blades 81 which are mutually offset in the stamping plane in a known manner, one of which is shown in FIG. 8. Each stamping blade 81 cooperates with an annular opposing blade 82. Between the stamping blades 81 and opposing blades 82 there is guided a web of cotton wool 83 from which a respective cotton wool pad 1 is stamped by a stamping stroke of the stamping blade 81 against the opposing blade 82 and is pushed downwardly by the opposing blade 82 into the cylindrical channel 85 in the opposing blade carrier 86 by means of the discharge ram 84 displaceably guided in the stamping blade 81. As shown in FIG. 8, the holding block 7 stands in a holding aperture 87 of the bearing block 88 of the stamping machine 2 carrying the opposing blade carrier 86, the overhanging piston 47 being arranged in front of the through-aperture 55 of the holding chamber 5 and projecting from the through-aperture 55 with its annular shoulder 52. The diaphragm plates 56, 57 are positioned in such a way that the through-aperture is not constricted (FIG. 10). The cotton wool pads formed successively by the stamping machine 2 are deposited on the annular shoulder 52. The piston 47 is pressed down slowly by the increasing pressure of the expanding cotton wool pads 1 until a package 67 of cotton wool pads 1 has finally been inserted in the holding chamber 5 in a number desired by the respective packaging unit. It should be added that, during the stamping of the last cotton wool pad 1, the discharge ram 84 performs a greater stroke and completely traverses the duct 85 and pushes the package 67 completely into the holding chamber 5. After the discharge ram 84 has been driven back into the stamping blade 81, the cotton wool pads 1 are reliably held in the holding chamber 5 owing to closure of the diaphragm system 54, the diaphragm plates 56, 57 being conveyed into the configuration shown in FIG. 11 by means of the pivoting lever mechanism 59.

The intermediate storage system 4 is then driven down from the coupling position described hereinbefore, so that the holding block 7 travels downwardly from the holding aperture 87 in the bearing block 88 into the alternative position shown in FIG. 3 by actuation of the vertical slide 36. In this position, the revolving head 33 can be actuated and can be rotated through a rotational angle of 180° round the axis of rotation D. The two holding blocks 7 and 8 therefore change their position. The space required for the rotational movement is shown in dot dash lines in FIGS. 3 and 4 (funnel-shaped line in FIG. 3, elliptical line in FIG. 4).

The vertical slide 36 is then driven upwardly again so the holding block 8 with the empty holding chambers 6 is conveyed into the coupling position shown in FIG. 8 and the holding block 7 with the filled holding chambers 5 into the coupling position with the transfer station 11 shown in FIG. 2. In this position of the intermediate storage system 4, the holding chambers 6 of the holding block 8 can be filled in the manner just described.

The transfer of the packages 67 in the holding chambers 5 into the conveying cartridges 10 is explained as follows:

The manipulating platform 66 is activated after the intermediate storage system 4 has been raised into the coupling position. The empty conveying cartridges 10 conveyed into the horizontal portion 18 of the upper apron 13 by the advance system 31 are lifted by means of the orientating template 75 by raising the vertical slide 77 so they assume the configuration shown in FIGS. 5 and 6. The transverse slide 70 is then actuated so these conveying cartridges 10 can be coupled to the holding chambers 5 of the holding block 7 by means of the stop plate 73. The diaphragm system 54 is opened. Its diaphragm plates 56, 57 assume the position shown in FIG. 10. The delivery rams 44 are now pushed from behind into the holding chambers 5 by actuation of the pneumatic piston/cylinder drive 41, their heads 45 penetrating the through-aperture 53 in the piston 47 and conveying the package 67 from the holding chambers 5 into the respectively coupled conveying cartridge 10 with their face end.

The piston 47 is grasped by the annular collar 46 at the head 45 of the discharge rams 44 and is entrained into the position shown in FIG. 8. After the delivery rams 44 have been pulled back, the conveying cartridges 10 are brought back over the rails 15, 16 of the upper apron 13 by actuation of the transverse slide 70 and the orientating template 75 is then lowered by actuation of the vertical slide 77. The conveying cartridges 10 therefore lie serially in succession on the rails 15, 16 again. At the same time, the intermediate storage system 4 is driven downwards again and the revolving head 33 actuated so the positions of the holding blocks 7, 8 are changed again and the holding chambers 6 of the intermediate storage system 4, which have in the meantime been filled, can be emptied into the subsequent conveying cartridges 10 again in the manner just described.

The filled conveying cartridges 10 are carried off to the packaging station 3 and the conveying cartridges 10 emptied there are returned in the manner described at the outset via the upper and lower apron 13, 14, the lifting device 26 and the advance system 31.

We claim:

1. Handling device for conveying layered cellulose products which are formed in succession during production, between a production station and a packaging station comprising:

an intermediate storage system following the production station with at least one pair of separate holding chambers for the serial holding of the cellulose products successively delivered from the production station in a number corresponding to a packaging unit and for transferring the cellulose products held in this way as a package into a respective conveying cartridge, wherein one holding chamber of the pair, of which there is at least one, can be coupled to an outlet of the production station and at the same time the other holding chamber in a transfer station can be coupled to a respectively allocated conveying cartridge alternately and a conveyor belt by means of which a plurality of conveying cartridges can be conveyed between a transfer station in which a respective package (67) of cellulose products is transferred from one of the holding chambers of the intermediate storage system into an associated conveying cartridge and the packaging station in which the package can be conveyed from one of the respective conveying cartridges into a sales container.

2. A handling device as claimed in claim 1, in which the intermediate storage system comprises two holding blocks with respective adjacently arranged holding chambers which are open on both sides and are in equal numbers, the holding blocks being arranged in such a way that the longitudinal axes of the holding chambers in a holding block enclose a rightangle in each case with the longitudinal axes of the holding chambers in the other holding block and the holding chambers intersect one another in foot regions.

3. A handling device as claimed in claim 2 in which the holding blocks are mounted together on a rotatable revolving head of which the axis of rotation coincides with the rotational axis of symmetry defined by the two holding blocks with respect to a rotational angle of 180°.

4. A handling device as claimed in claim 3 in which the revolving head is mounted so as to be vertically displaceable on a vertical slide between a coupling position on the one hand in which the holding chambers of the two holding blocks are coupled to the production station and transfer station and an alternative position, on the other hand, in which the revolving head is freely rotatable in space with the holding blocks.

5. A handling device as claimed in claim 2 in which the intermediate storage system is allocated a discharge system which, by means of delivery rams which can be pushed longitudinally axially through the holding chambers coupled to the transfer station, conveys the package of cellulose products located therein into the respectively allocated conveying cartridges.

6. A handling device as claimed in claim 5 in which an overhanging piston is mounted on each holding chamber so as to be displaceable longitudinally axially under the stack pressure of the cellulose products delivered from the production station and in which the piston has a central through-aperture for a head of the delivery ram, the head having a driver for the piston.

7. A handling device as claimed in claim 1, in which an overhanging piston is mounted on each holding chamber so as to be displaceable longitudinally axially under the stack pressure of the cellulose products delivered from the production station.

8. A handling device as claimed in claim 1, in which a diaphragm system which can be moved to and fro between an open position in which a cross section of the holding chambers is completely exposed and a closed position in which the diaphragm system laterally constricts a free cross section of a through-aperture of the holding chambers is arranged in front of the through-aperture of the holding chambers.

9. A handling device as claimed in claim 1, in which the transfer station has a manipulating platform by means of which empty conveying cartridges supplied from the packaging station can be orientated according to the arrangement of the holding chambers and can be coupled to them in order to transfer the package of cellulose products located therein.

10. A handling device as claimed in claim 9 in which the manipulating platform has a vertical slide with a positioning holder for lifting the conveying cartridges from the conveyor belt and for orientating the conveying cartridges and a horizontal slide for coupling the conveying cartridges to the respectively allocated holding chambers.

* * * * *